US009017039B2

(12) United States Patent
Toyota et al.

(10) Patent No.: US 9,017,039 B2
(45) Date of Patent: Apr. 28, 2015

(54) HYDRAULIC PUMP OPERATING DEVICE AND METHOD FOR USE IN HYDRAULIC SYSTEM

(75) Inventors: Toshihisa Toyota, Kobe (JP); Shuhei Ohtsuka, Kakogawa (JP); Keita Morikawa, Kobe (JP); Tomoya Sakuma, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 494 days.

(21) Appl. No.: 13/322,300

(22) PCT Filed: Sep. 29, 2010

(86) PCT No.: PCT/JP2010/005844
§ 371 (c)(1),
(2), (4) Date: Jan. 25, 2012

(87) PCT Pub. No.: WO2011/045900
PCT Pub. Date: Apr. 21, 2011

(65) Prior Publication Data

US 2012/0189463 A1 Jul. 26, 2012

(30) Foreign Application Priority Data

Oct. 14, 2009 (JP) ..... 2009-237170

(51) Int. Cl.
*F04B 49/20* (2006.01)
*F04B 49/02* (2006.01)

(52) U.S. Cl.
CPC ..... *F04B 49/022* (2013.01); *F04B 49/20* (2013.01); *F04B 2205/01* (2013.01);
(Continued)

(58) Field of Classification Search
CPC .... F04B 49/20; F04B 49/022; F04B 2205/02; F04B 2205/05; F04B 2205/07
USPC ..... 417/1, 44.2, 321, 63, 362
See application file for complete search history.

(56) References Cited

U.S. PATENT DOCUMENTS 5,522,707 A * 6/1996 Potter ..... 417/4
6,308,516 B1 * 10/2001 Kamada ..... 60/450
(Continued)

FOREIGN PATENT DOCUMENTS

CN 1594882 A 3/2005
JP A 9-151859 6/1997
(Continued)

OTHER PUBLICATIONS

International Search Report issued in International Patent Application No. PCT/JP2010/005844 dated Dec. 21, 2010.
(Continued)

*Primary Examiner* — Charles Freay
*Assistant Examiner* — Lilya Pekarskaya
(74) *Attorney, Agent, or Firm* — Oliff PLC

(57) ABSTRACT

The rotational frequency of a variable speed motor is set to a normal rotational frequency setting value (N1). A pressure variation range (ΔP) is detected based on a pressure detection value P, of a variable displacement pump, detected by a pressure detector. It is determined whether a determination that the detected pressure variation range (ΔP) is less than or equal to a pressure maintained state detection level (L1) has been continuously given for a period indicated by a timer setting value (T1). If the determination that the detected pressure variation range (ΔP) is less than or equal to the pressure maintained state detection level (L1) has been continuously given for the predetermined period, then it is detected that the current state is a pressure maintained state, and the rotational frequency of the variable speed motor is switched from the normal rotational frequency setting value N1 to a pressure maintaining rotational frequency setting value (N2(<N1)).

7 Claims, 9 Drawing Sheets

(52) U.S. Cl.
CPC .. *F04B 2205/05* (2013.01); *F15B 2211/20515* (2013.01); *F15B 2211/20546* (2013.01); *F15B 2211/6309* (2013.01); *F15B 2211/6651* (2013.01)

(56) References Cited

U.S. PATENT DOCUMENTS

| | | | | |
|---|---|---|---|---|
| 6,748,739 | B1 * | 6/2004 | Hirano et al. | 60/431 |
| 2005/0000272 | A1 * | 1/2005 | Takemura et al. | 73/35.01 |
| 2005/0053483 | A1 | 3/2005 | Iimura et al. | |
| 2006/0070448 | A1 * | 4/2006 | Baumann et al. | 73/730 |
| 2006/0142930 | A1 * | 6/2006 | Okubo et al. | 701/114 |

FOREIGN PATENT DOCUMENTS

| | | |
|---|---|---|
| JP | A 11-336701 | 12/1999 |
| JP | A-2000-027766 | 1/2000 |
| JP | A-2003-172302 | 6/2003 |
| JP | A-2006-177560 | 7/2006 |
| JP | A-2009-216182 | 9/2009 |

OTHER PUBLICATIONS

Dec. 9, 2013 Office Action and Search Report issued in Chinese Patent Application No. 201080023809.6 (w/ partial translation).

* cited by examiner

HYDRAULIC PUMP OPERATING DEVICE AND METHOD FOR USE IN HYDRAULIC SYSTEM

TECHNICAL FIELD

The present invention relates to a hydraulic pump operating device and method for use in hydraulic systems.

BACKGROUND ART

In hydraulic systems, a hydraulic oil is supplied to hydraulic actuators (such as a hydraulic cylinder and a hydraulic motor) and thereby the hydraulic actuators are operated. Hydraulic systems are widely used in the fields of, for example, construction machinery, industrial vehicles, industrial machinery, and ships and vessels. There are proposed hydraulic systems in which the discharge pressure of a hydraulic pump is detected by a pressure detector and the speed of a variable speed motor configured to drive the hydraulic pump is controlled by using the detected discharge pressure so as to prevent the occurrence of a wasteful amount of discharge at a time when the hydraulic pressure is high.

One example of such a hydraulic system as above is an inverter-driven hydraulic unit disclosed in Patent Literature 1. FIG. 8 shows a configuration of the inverter-driven hydraulic unit. In FIG. 8, an inverter-driven hydraulic unit 1 includes a variable displacement piston pump 2, a variable speed motor 3, an inverter device 4, a pressure sensor 5, and a controller 6. The inverter device 4 and the controller 6 are accommodated in a control panel 7. The variable displacement piston pump 2 includes a pressure adjustment mechanism 9. If the discharge pressure of the variable displacement piston pump 2 reaches a cut-off start pressure, which is slightly lower than a pressure that is set by means of a pressure adjustment screw 15 urged by a spring 10, then the discharge pressure and discharge amount are mechanically controlled by the pressure adjustment mechanism 9. It should be noted that the pressure sensor 5 is configured such that when detecting the value of the discharge pressure, the pressure sensor 5 sends a pressure signal 13, which indicates the detected value, to the controller 6.

As shown in FIG. 9, rotational frequency conditions 12, which correspond to respective operation conditions of the controller 6, are set in advance. The rotational frequency conditions 12 shown in FIG. 9 are represented by a function that is defined by a broken line connecting five points that are set in advance in the controller 6. These five points are set corresponding to hydraulic oil flow rate conditions required by the hydraulic actuator side. Specifically, the rotational frequency of the variable speed motor 3 remains constant at Nc when the discharge pressure of the variable displacement piston pump 2 is in the range from Pa to Pb; the rotational frequency decreases in accordance with an increase in the discharge pressure when the discharge pressure is in the range from Pb to Pc; the rotational frequency is Nb when the discharge pressure is Pc; the rotational frequency further decreases in accordance with an increase in the discharge pressure when the discharge pressure is in the range from Pc to Pd (Pd is a cut-off start pressure); the rotational frequency is Na when the discharge pressure is Pd; and the rotational frequency remains constant at Na when the discharge pressure is in the range from Pd (cut-off start pressure) to Pe (full cut-off pressure). These rotational frequency conditions are set in the controller 6 in advance.

As described above, during a period until the discharge pressure reaches the cut-off start pressure, the discharge amount is controlled by an inverter rotational frequency command from the variable speed motor 3, which is generated based on the discharge pressure detected by the pressure sensor 5 and based on the rotational frequency conditions 12. When the discharge pressure is in the range from the cut-off start pressure to the full cut-off pressure, the discharge amount and discharge pressure are mechanically controlled by the pressure adjustment mechanism 9.

CITATION LIST

Patent Literature

PTL 1: Japanese Laid-Open Patent Application Publication No. 2003-172302

SUMMARY OF INVENTION

Technical Problem

The controller 6 disclosed in Patent Literature 1 generates the inverter rotational frequency command, directly based on a detection value of the discharge pressure detected by the pressure sensor 5, by referring to the rotational frequency conditions 12 which are set in advance and which contain discharge pressure versus rotational frequency characteristics. This may cause problems as described below.

Firstly, if the offset of the pressure detection value of the pressure sensor 5 varies or the hysteresis width of the pressure sensor 5 increases due to factors such as aging or temperature change, then a problem may arise where a proper inverter rotational frequency command is not generated. It is also conceivable that a proper inverter rotational frequency command is not generated as a result of harmonic noise, which is caused by inverter-driven operations, being applied to the pressure detection value of the pressure sensor 5.

Secondly, the rotational frequency conditions 12, which are referred to at the time of generating the inverter rotational frequency command, contain the discharge pressure versus rotational frequency characteristics, which are represented in the form of a broken line or a curved line. This causes the inverter rotational frequency command to vary in accordance with variation in the pressure detection value of the pressure sensor 5, resulting in variation in the rotational frequency of the variable speed motor 3. Consequently, a problem may occur where control over the variable speed of the variable speed motor 3 based on the rotational frequency conditions 12 becomes unstable. If such a problem occurs, the unstable control over the variable speed motor 3 becomes a factor that causes hunting (i.e., pulsation) of the discharge pressure and unstable operation of the variable speed motor 3.

Therefore, an object of the present invention is to stabilize control in the case of controlling the speed of a variable speed motor by using the discharge pressure of a hydraulic pump, in particular, in the case of controlling the speed of a variable speed motor configured to drive a variable displacement pump, aiming at saving energy when the variable displacement pump is in a pressure maintained state.

Solution to Problem

A main invention that has been made to solve the above-described problems is a hydraulic pump operating device for use in a hydraulic system. The hydraulic system includes: a variable speed motor; a hydraulic pump driven by the variable speed motor; and a pressure detector configured to detect a discharge pressure of the hydraulic pump. The hydraulic pump operating device includes: a pressure variation range detector configured to detect a range of variation of the discharge pressure detected by the pressure detector; and a speed controller configured to control the speed of the variable speed motor based on the detected range of variation of the discharge pressure.

According to the above hydraulic pump operating device, in the case of controlling the speed of the variable speed motor by using the discharge pressure of the hydraulic pump, the speed of the variable speed motor is controlled not directly based on the discharge pressure (absolute value) detected by the pressure detector but based on the range of variation of the discharge pressure. Therefore, the control is not affected by influences of the variation of the discharge pressure detected by the pressure detector and the magnitude of its hysteresis width.

The above hydraulic pump operating device may further include a pressure maintained state detector. The pressure maintained state detector may detect a state where the discharge pressure is maintained, based on the range of variation of the discharge pressure which is detected by the pressure variation range detector. If the pressure maintained state detector detects the state where the discharge pressure is maintained, then the speed controller may decelerate the variable speed motor.

According to the above hydraulic pump operating device, the motor rotational frequency of the variable speed motor is reduced during the pressure maintained state. This mainly reduces mechanical loss caused by agitation resistance of the hydraulic pump, resulting in a reduction in electric power consumed by the variable speed motor.

In the above hydraulic pump operating device, the pressure maintained state detector may determine whether a state where the range of variation of the discharge pressure, which is detected by the pressure variation range detector, is less than or equal to a first threshold has continued for a predetermined period. The pressure maintained state detector may detect the state where the discharge pressure is maintained when having determined that the state where the range of variation of the discharge pressure is less than or equal to the first threshold has continued for the predetermined period.

According to the above hydraulic pump operating device, it is determined whether the state where the detected range of variation of the discharge pressure is less than or equal to the first threshold has continued for the predetermined period. Therefore, even if noise is contained in the detected range of variation of the discharge pressure, the state where the discharge pressure is maintained can be detected assuredly.

In the above hydraulic pump operating device, if the pressure maintained state detector detects the state where the discharge pressure is maintained, then the speed controller may switch the rotational frequency of the variable speed motor from a first rotational frequency to a second rotational frequency which is lower than the first rotational frequency.

According to the above hydraulic pump operating device, the rotational frequency of the variable speed motor is not continuously controlled in accordance with the discharge pressure detected by the pressure detector, but is switched between the first rotational frequency and the second rotational frequency based on the range of variation of the discharge pressure, that is, a two-stage switching control method. By employing this method, even if the discharge pressure detected by the pressure detector significantly varies, the control over the variable speed motor can be stabilized since such variation is not continuously followed.

The above hydraulic pump operating device may further include a pressure drop detector. The pressure drop detector may determine whether the discharge pressure detected by the pressure detector is less than or equal to a second threshold. If the pressure drop detector determines that the discharge pressure is less than or equal to the second threshold, then the speed controller may either maintain the rotational frequency of the variable speed motor at the first rotational frequency, or switch the rotational frequency of the variable speed motor from the second rotational frequency to the first rotational frequency.

According to the above hydraulic pump operating device, if the discharge pressure gradually decreases when the variable speed motor is being driven at the second rotational frequency, the rotational frequency of the variable speed motor is instantaneously switched from the second rotational frequency to the first rotational frequency. This prevents a pressure drop in the pressure maintained state.

In the above hydraulic pump operating device, the pressure variation range detector may detect the range of variation of the discharge pressure detected by the pressure detector by high-pass filtering the discharge pressure.

According to the above hydraulic pump operating device, the range of instantaneous variation of the obtained discharge pressure can be detected through high-pass filtering. As a result, the control over the speed of the variable speed motor can be stabilized.

The hydraulic pump operating device may further include a first threshold calculator. The hydraulic pump operating device may be configured in the following manner: the speed controller switches the rotational frequency of the variable speed motor from the first rotational frequency to the second rotational frequency; and then, for a predetermined period, the pressure variation range detector detects the range of variation of the discharge pressure, and the first threshold calculator detects the lower limit value of the range of variation detected by the pressure variation range detector and calculates the first threshold based on the detected lower limit value.

According to the above hydraulic pump operating device, the rotational frequency of the variable speed motor is, when it is stable at the first rotational frequency, switched from the first rotational frequency to the second rotational frequency. In this manner, a state where the discharge pressure detected by the pressure detector varies is simulated. Then, for the predetermined period, values of the range of variation of the discharge pressure are sequentially detected, and the lower limit value among the detected values of the range of variation (i.e., a detected value that indicates a negative change amount and of which the absolute value is greatest among detected values indicating negative change amounts) is obtained. Since the range of variation of the discharge pressure does not fall below the obtained lower limit value, the lower limit value can be used as a reference for the first threshold. Therefore, the first threshold can be automatically set based on the obtained lower limit value.

Another main invention that has been made to solve the above-described problems is a method of operating a hydraulic pump in a hydraulic system. The hydraulic system includes: a variable speed motor; a hydraulic pump driven by the variable speed motor; and a pressure detector configured to detect a discharge pressure of the hydraulic pump. The method includes: detecting, by a pressure variation range detector, a range of variation of the discharge pressure detected by the pressure detector; and controlling, by a speed controller, the speed of the variable speed motor based on the detected range of variation of the discharge pressure.

Advantageous Effects of Invention

According to the present invention, in the case of controlling the speed of the variable speed motor by using the discharge pressure of the hydraulic pump, in particular, in the case of controlling the speed of the variable speed motor aiming at saving energy when the hydraulic pump is in the pressure maintained state, the control over the speed of the variable speed motor can be stabilized.

DESCRIPTION OF EMBODIMENTS

Figure 1:
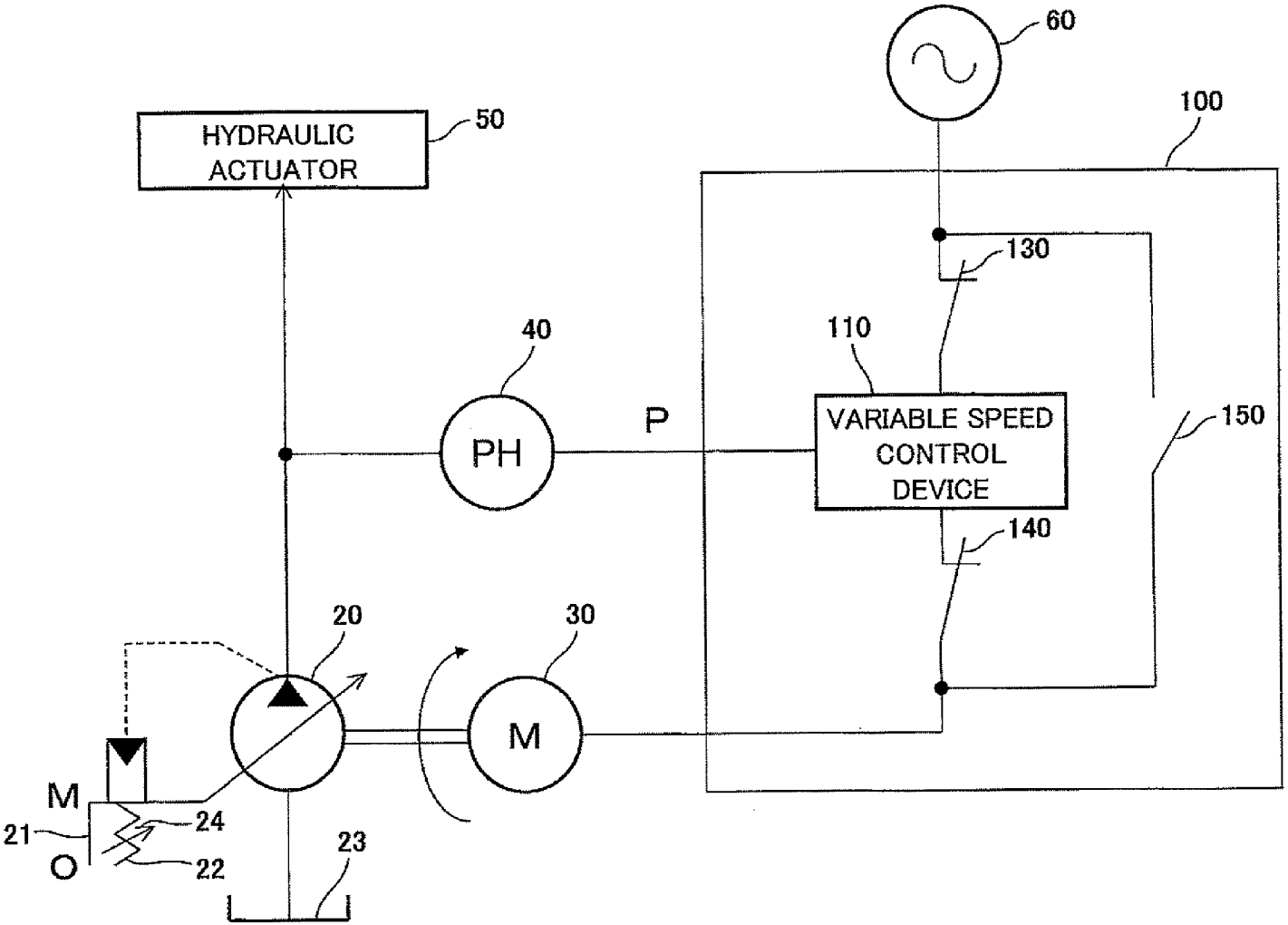
FIG. 1 shows a configuration of a hydraulic system according to Embodiment 1 of the present invention.

Hereinafter, preferred embodiments of the present invention will be described with reference to the accompanying drawings. In the drawings, the same or corresponding components are denoted by the same reference signs, and a repetition of the same description is avoided.

(Embodiment 1)

[Configuration of Hydraulic System]

FIG. 1 shows a configuration of a hydraulic system according to Embodiment 1 of the present invention.

The hydraulic system shown in FIG. 1 includes a variable displacement pump 20, a variable speed motor 30, a pressure detector 40, a control panel 100, and a hydraulic actuator 50.

The variable displacement pump 20 is a hydraulic pump configured to suck up oil from a pressure oil tank 23 and to discharge the oil to the hydraulic actuator 50. The variable displacement pump 20 includes a pressure adjusting mechanism 21 configured to mechanically control the position of a discharge amount variable component based on the discharge pressure. It should be noted that in the present embodiment, the pressure adjusting mechanism 21 refers to a mechanism configured to mechanically control the discharge pressure and discharge amount when the discharge pressure substantially reaches a setting pressure which is set by means of a pressure adjustment screw 24 urged by a spring 22. For example, in a case where the variable displacement pump 20 is a variable displacement piston pump, the discharge amount variable component refers to a swashplate, and in a case where the variable displacement pump 20 is a variable displacement vane pump, the discharge amount variable component refers to a cam ring.

The variable speed motor 30 is connected to the variable displacement pump 20, and is configured to drive the drive shaft of the variable displacement pump 20. The variable speed motor 30 is an induction motor which is direct-driven by a commercial power supply 60, or inverter-driven by a variable speed control device 110. It should be noted that the variable speed motor 30 is not limited to an induction motor, but may be a synchronous motor.

The pressure detector 40 is set at the discharge side of the variable displacement pump 20, and is configured to continuously detect the discharge pressure of the variable displacement pump 20. A pressure sensor, pressure switch, or the like may be used as the pressure detector 40.

The control panel 100 is connected to the commercial power supply 60, the pressure detector 40, and the variable speed motor 30. To be specific, a commercial AC voltage (commercial frequency f1 (50 Hz or 60 Hz)) supplied from the commercial power supply 60 to the variable speed control device 110, and a pressure detection value P detected by the pressure detector 40, are inputted to the control panel 100. The control panel 100 supplies the variable speed motor 30 with a motor driving AC voltage for which a normal rotational frequency setting value N1 or a pressure maintaining rotational frequency setting value N2 is set. These setting values N1 and N2, which will be described below, are outputted from the variable speed control device 110. The normal rotational frequency setting value N1 and the pressure maintaining rotational frequency setting value N2 will be described below.

The control panel 100 accommodates therein the variable speed control device 110 (which is one mode of a hydraulic pump operating device) and contactors 130, 140, and 150. The contactor 130 is provided at the wiring between the commercial power supply 60 and the variable speed control device 110. The contactor 140 is provided at the wiring between the variable speed control device 110 and the variable speed motor 30. The contactor 150 is provided parallel to the contactor 130, the variable speed control device 110, and the contactor 140. The control panel 100 is configured such that the control panel 100 controls the contactor 130 and the contactor 140 to be ON and the contactor 150 to be OFF in the case of driving the variable speed motor 30 by means of the variable speed control device 110, and the control panel 100 controls the contactor 130 and the contactor 140 to be OFF and the contactor 150 to be ON in the case of driving the variable speed motor 30 by means of the commercial power supply 60 when a failure has occurred in the variable speed control device 110.

It should be noted that in the present embodiment, the contactors 130, 140, and 150 are configured to enter their respective ON/OFF states through manual operations of switches (not shown). However, as an alternative, the contactors 130, 140, and 150 may be configured to automatically enter their respective ON/OFF states for driving the variable speed motor 30 by means of the commercial power supply 60 when a signal indicating a breakdown of the variable speed control device 110 is received.

The present embodiment describes a case where the hydraulic pump is the variable displacement pump 20. However, the present embodiment also applies to a case where the hydraulic pump is a fixed displacement pump of which the discharge pressure and discharge flow rate are controlled through inverter-driven motor rotational frequency control.

[Configuration of Hydraulic Pump Operating Device]

Figure 2:
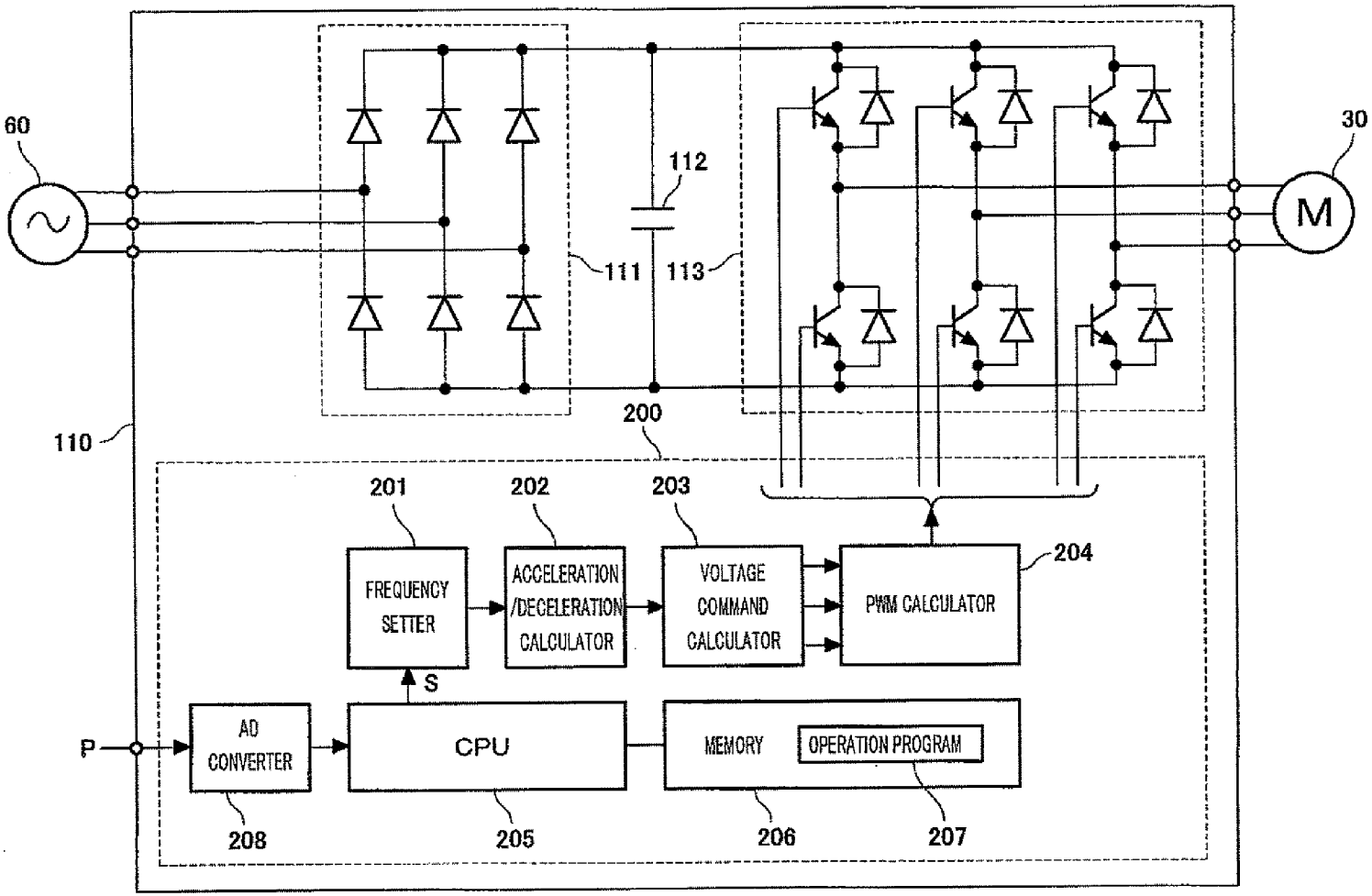
FIG. 2 shows a configuration of a variable speed control device according to Embodiment 1 of the present invention.

FIG. 2 shows a configuration of the variable speed control device 110 according to the embodiment of the hydraulic pump operating device of the present invention.

The variable speed control device 110 includes: a diode rectifier 111 configured to perform full-wave rectification of the voltage of the commercial power supply 60; a smoothing capacitor 112 configured to smooth the voltage rectified by the diode rectifier 111; an inverter circuit 113 configured to convert a DC voltage at both ends of the smoothing capacitor 112 into an AC voltage of a desired voltage and frequency, and to supply power to the variable speed motor 30; and a controller 200 configured to control the inverter circuit 113.

The controller 200 includes: a frequency setter 201 configured to set a frequency to be outputted from the inverter circuit 113; an acceleration/deceleration calculator 202 configured such that in a case where the frequency set by the frequency setter 201 is changed from ω0 to ω1, the acceleration/deceleration calculator 202 changes a frequency setting value from ω0 to ω1 with a predetermined slope (a predetermined slope herein refers to an increase or decrease in the frequency setting value at constant acceleration), so that the frequency is changed smoothly; a voltage command calculator 203 configured to calculate a voltage setting value for output voltage of the inverter circuit 113, based on the frequency setting value outputted from the acceleration/deceleration calculator 202; a PWM calculator 204 configured to perform PWM (pulse width modulation) calculation based on the frequency setting value and the voltage setting value to output a signal for turning on/off a transistor of the inverter circuit 113; a CPU 205 configured to perform overall control; and a memory 206 accessible by the CPU 205. It should be noted that the CPU 205 obtains the pressure detection value P detected by the pressure detector 40, and based on the obtained pressure detection value P, sets a frequency for the frequency setter 201.

[Functional Block Diagram of Controller]

Figure 3:
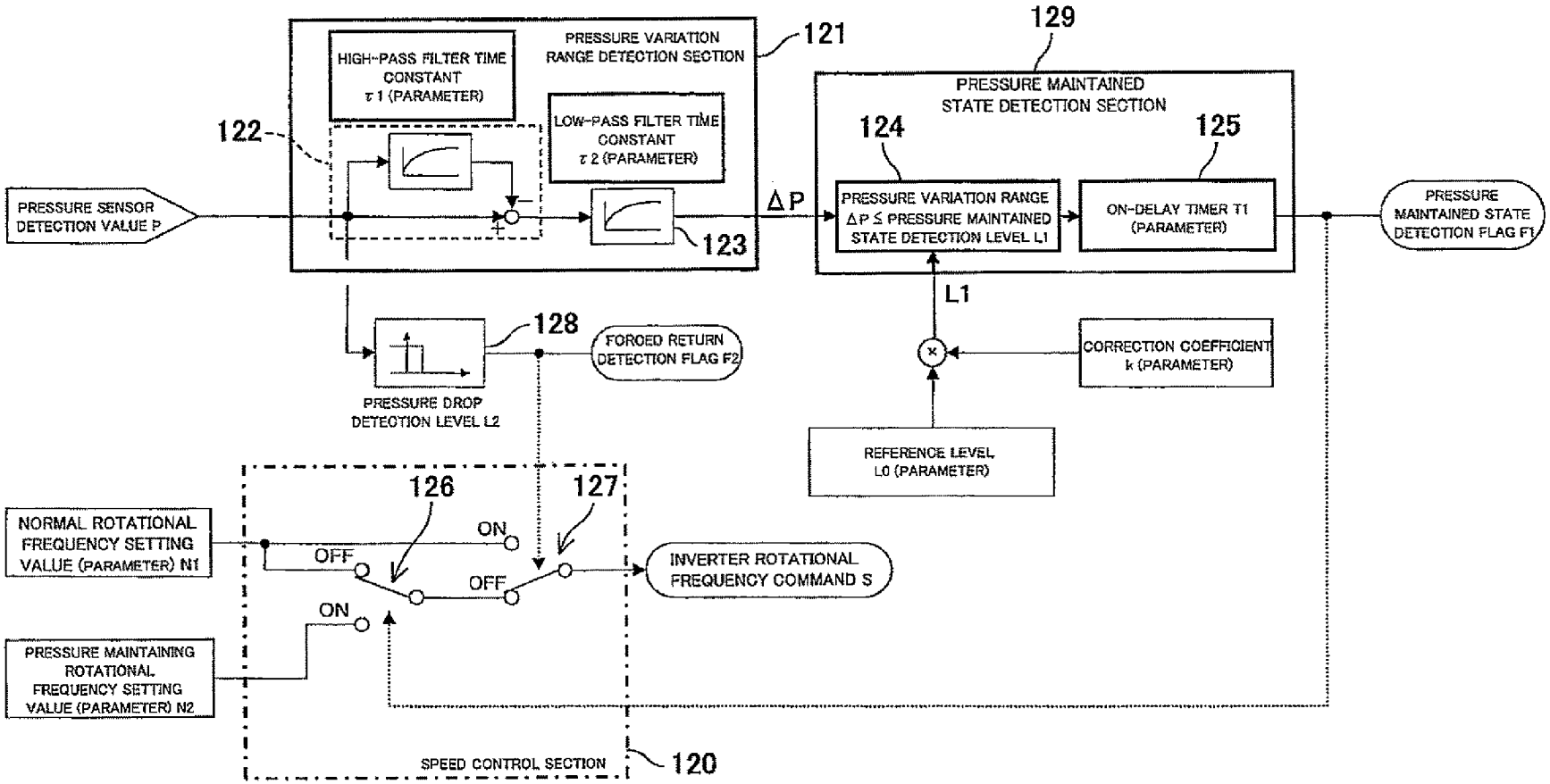
FIG. 3 is a functional block diagram of a controller in FIG. 2.

FIG. 3 is a functional block diagram of the controller 200 according to Embodiment 1 of the present invention. It should be noted that in the present embodiment, a pressure variation range detection section (one mode of the pressure variation range detector) 121, a pressure maintained state detection section (one mode of the pressure maintained state detector) 129, a speed control section (one mode of the speed controller) 120, and a pressure drop detection section (one mode of the pressure drop detector) 128, which are shown in the functional block diagram of FIG. 3, are implemented as functions realized by an operation program 207 shown in FIG. 2. Moreover, a time constant τ1 of a high-pass filter section 122, a time constant τ2 of a low-pass filter section 123, a reference level L0, a correction coefficient k, a timer setting value T1 of an on-delay timer section 125, a pressure maintained state detection level L1, a pressure drop detection level L2, the normal rotational frequency setting value N1, and the pressure maintaining rotational frequency setting value N2, which are shown in the functional block diagram of FIG. 3, are parameters of the operation program 207. Furthermore, a pressure maintained state detection flag F1 and a forced return detection flag F2, which are shown in the functional block diagram of FIG. 3, represent respective statuses, each of which indicates a determination result of the operation program 207.

The pressure variation range detection section 121 performs arithmetic processing for detecting a pressure variation range ΔP of the pressure detection value P detected by the pressure detector 40. It should be noted that in the present embodiment, the pressure variation range ΔP obtained by the pressure variation range detection section 121 is the range of instantaneous variation, which indicates the amount of variation of the pressure detection value P per unit time (absolute value of an instantaneous value).

The pressure variation range detection section 121 includes the high-pass filter section 122 and the low-pass filter section 123 which are components for obtaining the range of instantaneous variation of the pressure detection value P. The high-pass filter section 122 acts as a filter configured to pass the high-frequency component of the pressure detection value P. The high-pass filter section 122 is realized by subtracting, from the pressure detection value P, the pressure detection value P that is delayed by using the time constant τ1 (parameter). The low-pass filter section 123 acts as a filter configured to smooth the pressure detection value P that has passed through the high-pass filter section 122, and to remove harmonic noise from the pressure detection value P. The low-pass filter section 123 is realized by delaying the pressure detection value P that has passed through the high-pass filter section 122, by using the time constant τ2 (parameter). It should be noted that the pressure variation range detection section 121 is not limited to the above configuration. For example, a difference between the peak hold value and the bottom hold value of the pressure detection value P per unit time may be detected. Further alternatively, a differential operation may be performed on the pressure detection value P. It should be noted that the low-pass filter section 123 may be eliminated for the purpose of simplifying the configuration.

The pressure maintained state detection section 129 detects a pressure maintained state based on the pressure variation range ΔP detected by the pressure variation range detection section 121. It should be noted that the pressure maintained state herein refers to a standby state where the hydraulic pressure has substantially reached the full cut-off pressure due to the hydraulic actuator 50 having stopped operating, and where almost no oil discharge amount is required and the discharge pressure is maintained. To be specific, the pressure maintained state detection section 129 includes a pressure variation range determination section 124 and the on-delay timer section 125.

The pressure variation range determination section 124 compares the pressure variation range ΔP, which is detected by the pressure variation range detection section 121, with the pressure maintained state detection level L1, and determines whether the pressure variation range ΔP is less than or equal to the pressure maintained state detection level L1 (ΔP≤L1). If it is determined "ΔP≤L1", then the pressure variation range determination section 124 outputs "1". On the other hand, if it is determined "ΔP>L1", then the pressure variation range determination section 124 outputs "0". It should be noted that the pressure maintained state detection level L1 represents a threshold for detecting the pressure maintained state. The pressure maintained state detection level L1 is obtained by multiplying the reference level L0 (i.e., the lower limit value of the pressure variation range ΔP during a measurement period), which is automatically set by an auto-tuning function described below, by the correction coefficient k.

The on-delay timer section 125 outputs "0 (indicating that the pressure maintained state is not detected)" while the output of "1 (ΔP≤L1)" from the pressure variation range determination section 124 continues for a period indicated by the timer setting value T1, and outputs "1 (indicating that the pressure maintained state is detected)" if the output of "1" from the pressure variation range determination section 124 has continued for the period indicated by the timer setting value T1. It should be noted that the event of outputting "1" from the on-delay timer section 125 indicates the detection of the pressure maintained state, and the event causes the pressure maintained state detection flag F1 to be ON.

When the on-delay timer section 125 is outputting "1", if the pressure variation range determination section 124 outputs "0 (ΔP>L1)", the on-delay timer section 125 outputs "0" at the same time. This event indicates that the discharge of oil from the variable displacement pump 20 has become necessary again.

The speed control section 120 includes switch sections 126 and 127, and is configured as follows. In a case where the pressure maintained state detection flag F1 is set to OFF (F1=0), the switch sections 126 and 127 are both turned off. Accordingly, the speed control section 120 selects and outputs the normal rotational frequency setting value N1 (e.g., 1800 rpm). On the other hand, in a case where the pressure maintained state detection flag F1 is set to ON (F1=1), if the switch section 126 is turned on and the switch section 127 is turned off, the speed control section 120 selects and outputs the pressure maintaining rotational frequency setting value N2 (e.g., 600 to 800 rpm), which is less than the normal rotational frequency setting value N1. It should be noted that due to the characteristics of the variable displacement pump 20, the lower limit value of the pressure maintaining rotational frequency setting value N2 is set in accordance with the specifications of the variable displacement pump 20.

Moreover, the speed control section 120 is configured such that in a case where the forced return detection flag F2, which will be described below, is set to ON, the speed control section 120 selects and outputs the normal rotational frequency setting value N1 by turning on the switch section 127 regardless of whether the pressure maintained state detection flag F1 is set to ON or not. It should be noted that an inverter rotational frequency command S is generated based on the normal rotational frequency setting value N1, or the pressure maintaining rotational frequency setting value N2, outputted from the speed control section 120.

The pressure drop detection section 128 compares the pressure detection value P, which is detected by the pressure detector 40, with the pressure drop detection level L2, and determines whether the pressure detection value P is less than or equal to the pressure drop detection level L2. In the present embodiment, the pressure drop detection section 128 outputs "0 (indicating that a pressure drop is not detected)" in the case of "P>L2", and outputs "1 (indicating that a pressure drop is detected)" in the case of "P≤L2". The event of outputting "1(P≤L2)" from the pressure drop detection section 128 indicates that a pressure drop has been detected, and the event causes the forced return detection flag F2 to be ON.

[Hydraulic Pump Operating Method]

Figure 4:
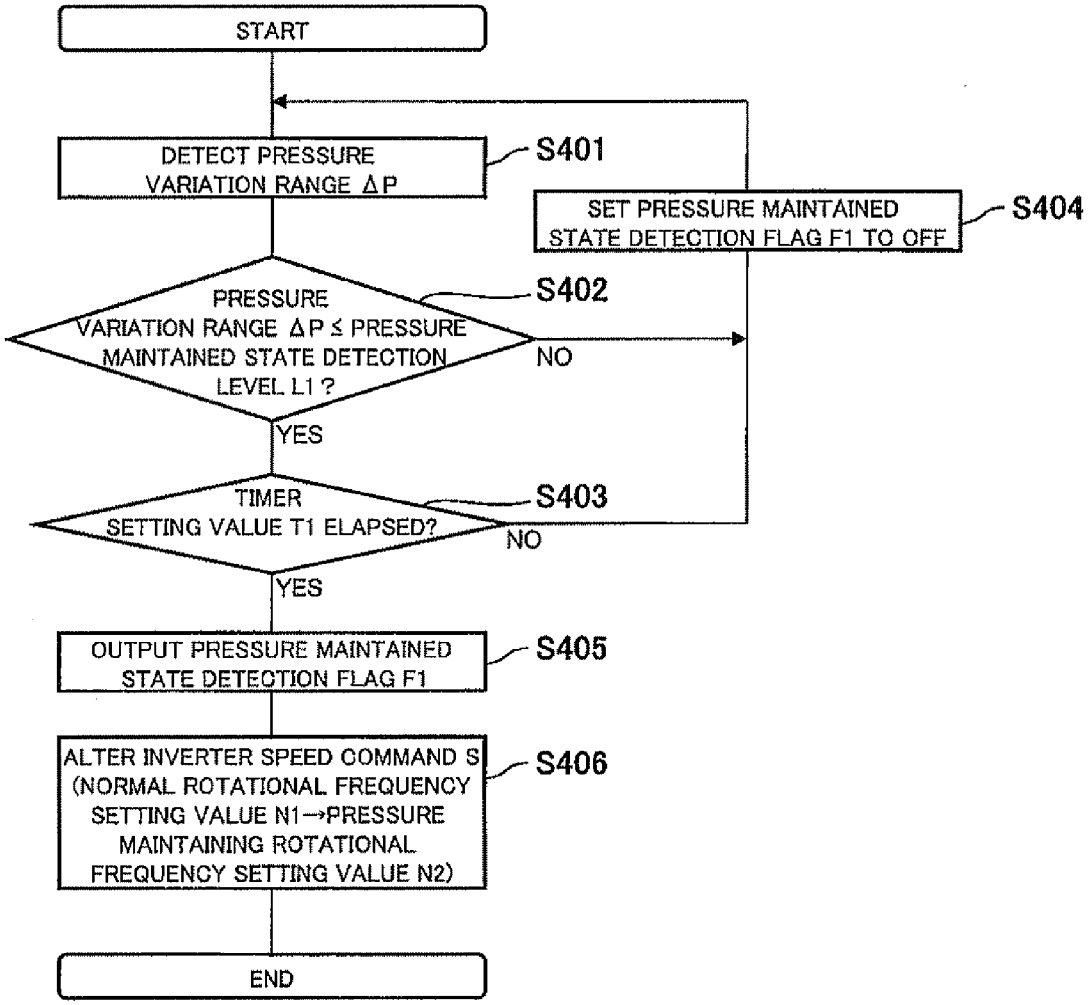
FIG. 4 is a flowchart showing a processing flow of a hydraulic pump operating method according to Embodiment 1 of the present invention.
Figure 5:
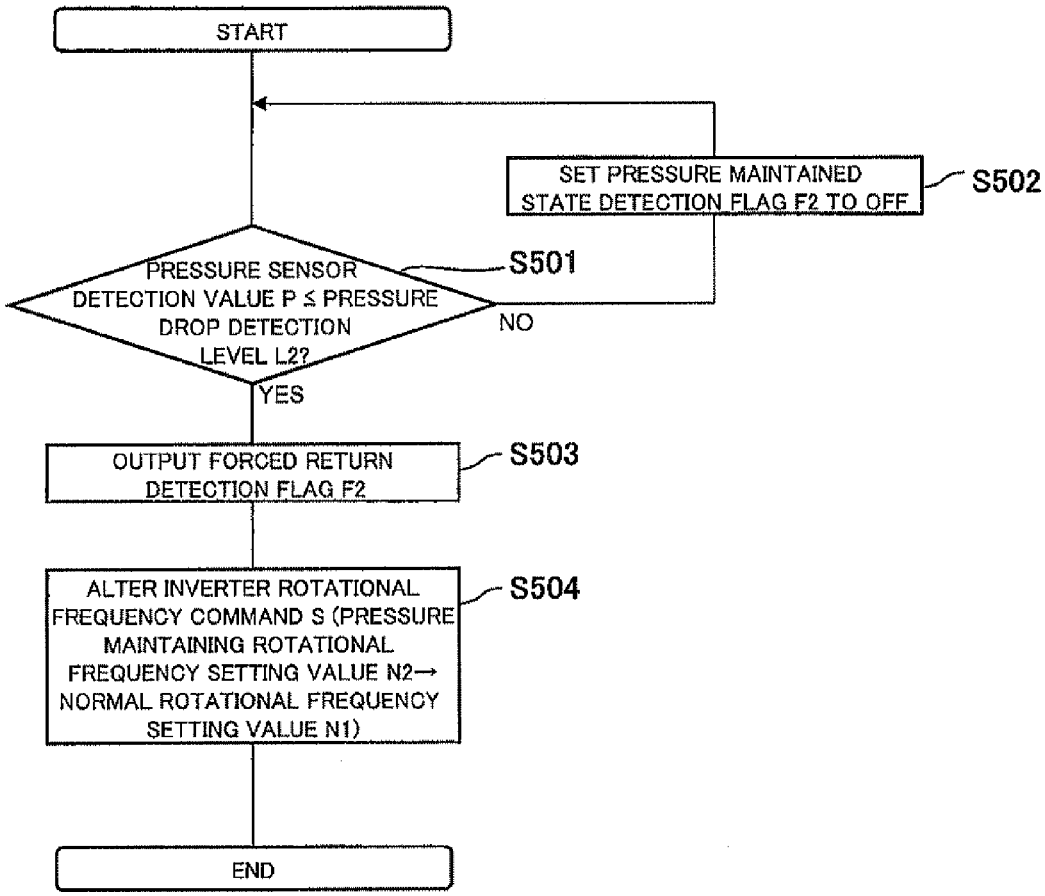
FIG. 5 is a flowchart showing a processing flow of the hydraulic pump operating method according to Embodiment 1 of the present invention.

FIGS. 4 and 5 are flowcharts each showing a flow of processing of the hydraulic pump operating device according to Embodiment 1 of the present invention.

First, in order to drive the variable speed motor 30, the CPU 205 loads the operation program 207 from the memory 206 and starts the execution thereof. It should be noted that the normal rotational frequency setting value N1 is selected as an initial setting of the operation program 207, and the inverter rotational frequency command S is generated based on the normal rotational frequency setting value N1.

Next, each time the CPU 205 obtains the pressure detection value P in digital amount, which is outputted from the AD converter 208, the CPU 205 generates, based on the obtained pressure detection value P in digital amount, the inverter rotational frequency command S for controlling the frequency conversion performed by the inverter circuit 113, and sends the inverter rotational frequency command S to the inverter circuit 113. Moreover, each time the CPU 205 obtains the pressure detection value P in digital amount from the AD converter 208, the CPU 205 detects the pressure variation range ΔP based on the obtained pressure detection value P (step S401).

Next, the CPU 205 determines whether the pressure variation range ΔP is less than or equal to the pressure maintained state detection level L1 (step S402). If it is determined that the pressure variation range ΔP is greater than the pressure maintained state detection level L1 (step S402: NO), the CPU 205 sets the pressure maintained state detection flag F1 to OFF in a case where the flag F1 is ON in advance (step S404), and returns to step S401. On the other hand, if it is determined that the pressure variation range ΔP is less than or equal to the pressure maintained state detection level L1 (step S402: YES), the CPU 205 further determines whether the pressure maintained state has continued for the period indicated by the timer setting value T1 (step S403). If the pressure maintained state has not yet continued for the period indicated by the timer setting value T1 (step S403: NO), the CPU 205 sets the pressure maintained state detection flag F1 to OFF in a case where the flag F1 is ON in advance (step S404), and returns to step S401. On the other hand; if the pressure maintained state has continued for the period indicated by the timer setting value T1 (step S403: YES), the CPU 205 sets the pressure maintained state detection flag F1 to ON and outputs the flag F1 (step S405).

Next, when the pressure maintained state detection flag F1 is set to ON (step S405), the CPU 205 alters the inverter rotational frequency command S in order to switch the rotational frequency of the variable speed motor 30 from the normal rotational frequency setting value N1 to the pressure maintaining rotational frequency setting value N2 (step S406). As a result, the variable speed motor 30 is driven at a rotational frequency that is low but enough to stably keep the pressure maintained state (i.e., driven at the pressure maintaining rotational frequency setting value N2), and the variable displacement pump 20 can be operated in such a manner that the pump displacement volume is mechanically controlled by means of the pressure adjusting mechanism 21 of the variable displacement pump 20. This makes it possible to save energy and lower the heat generation.

Here, detection as to whether the current state is the pressure maintained state is performed by monitoring the pressure variation range ΔP. However, there is a fear that the pressure maintained state may become not continuable due to a gradual decrease in the pressure detection value P. For this reason, the CPU 205 monitors the pressure detection value P at the same time as detecting the pressure variation range ΔP based on the pressure detection value P. To be specific, the CPU 205 determines whether the pressure detection value P is less than or equal to the pressure drop detection level L2 (step S501). If it is determined that the pressure detection value P is greater than the pressure drop detection level L2 (step S501: NO), the CPU 205 sets the forced return detection flag F2 to OFF. On the other hand, if it is determined that the pressure detection value P is less than or equal to the pressure drop detection level L2 (step S501: YES), the CPU 205 sets the forced return detection flag F2 to ON and outputs the flag F2 (step S503).

Next, when the forced return detection flag F2 is set to ON (step S503), the CPU 205 alters the inverter rotational frequency command S in order to switch the rotational frequency of the variable speed motor 30 from the pressure maintaining rotational frequency setting value N2 to the normal rotational frequency setting value N1 (step S504). As a result, abnormal detection due to pressure drop can be prevented.

[Advantageous Effects]

According to the present embodiment, at the time of entering the pressure maintained state (so-called a cut-off state) by means of the pressure adjusting mechanism 21, the variable speed control device 110 reduces the motor rotational frequency (N). This mainly reduces mechanical loss caused by agitation resistance of the hydraulic pump. Here, the load power (discharge pressure P×discharge amount Q) of the hydraulic pump shows substantially no change. Therefore, electric power consumed by the variable speed motor 30 is reduced by an amount that corresponds to the reduced mechanical loss. This adds an energy saving feature.

Further, according to the present embodiment, in the control intended to save energy by reducing the rotational frequency of the variable speed motor 30 during the pressure maintained state, the speed of the variable speed motor 30 is controlled based on the pressure variation range ΔP. Therefore, the control is not affected by the variation of the pressure detection value P of the pressure detector 40 and the magnitude of its hysteresis width.

Figure 9:
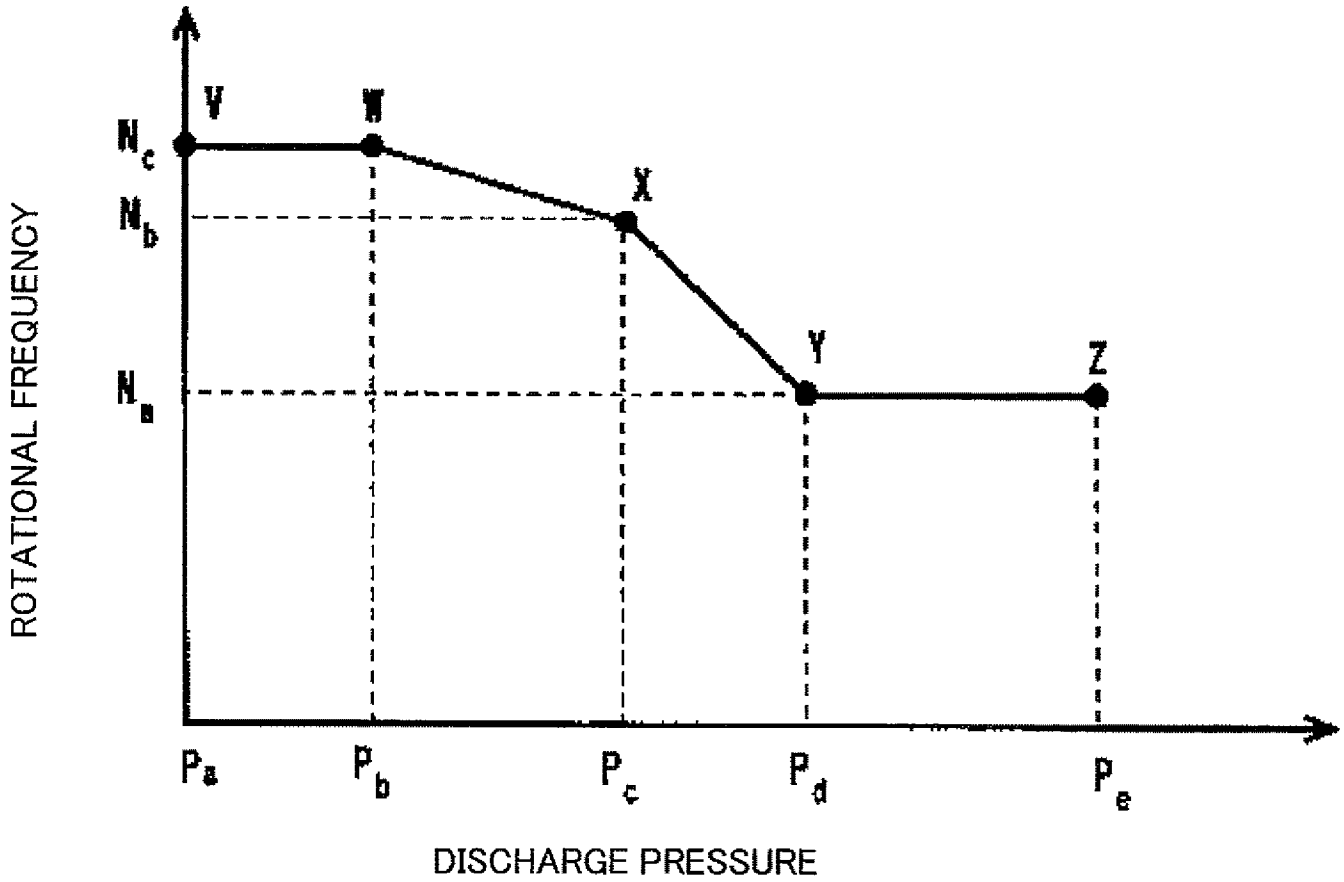
FIG. 9 is a diagram for use in describing rotational frequency conditions applied to the conventional hydraulic system (inverter-driven hydraulic unit).

Still further, according to the present embodiment, unlike the case of rotational frequency conditions shown in FIG. 9, the rotational frequency of the variable speed motor 30 is not continuously controlled in accordance with the pressure detection value P of the pressure detector 40, but is switched between the normal rotational frequency setting value N1 and the pressure maintaining rotational frequency setting value N2 based on the magnitude of the pressure variation range ΔP, that is, a two-stage switching control method. By employing this method, even if the pressure detection value P of the pressure detector 40 significantly varies, a hunting phenomenon due to mutual interference with the pressure adjusting mechanism 21 which mechanically controls the discharge amount of the variable displacement pump 20 can be suppressed.

Still further, according to the present embodiment, the hydraulic pump operating method, in which the variable speed motor 30 is controlled based on the pressure variation range ΔP, is realized as software provided in the variable speed control device 110. This eliminates the necessity of including a controller dedicated for the inverter in addition to the variable speed control device 110. Since wiring for connecting to such a controller dedicated for the inverter is not necessary, the influence of harmonic noise generated by the inverter is suppressed.

Still further, according to the present embodiment, in a case where the pressure detection value P decreases even in the pressure maintained state, the rotational frequency of the variable speed motor 30 is instantaneously switched to the normal rotational frequency setting value N1. This makes it possible to stably keep the pressure maintained state.

Still further, the present embodiment adopts backup functions using the contactors 130, 140, and 150. Accordingly, even if a failure occurs in the variable speed control device 110, the operation of the variable displacement pump 20 can be continued via the commercial power supply 60. This makes a quick recovery possible. Consequently, negative effects on production lines to which the hydraulic system is applied can be minimized.

(Embodiment 2)

[Auto-Tuning Function]

Embodiment 2 of the present invention is a result of adding, to Embodiment 1 of the present invention, an auto-tuning function which is a function of automatically setting the pressure maintained state detection level L1. It should be noted that the overall configuration of the hydraulic system (FIG. 1), the configuration of the variable speed control device 110 (FIG. 2), the functional block diagram of the controller 200 (FIG. 3), and the hydraulic pump operating method (FIGS. 4 and 5) are the same as described in Embodiment 1 of the present invention.

Figure 6:
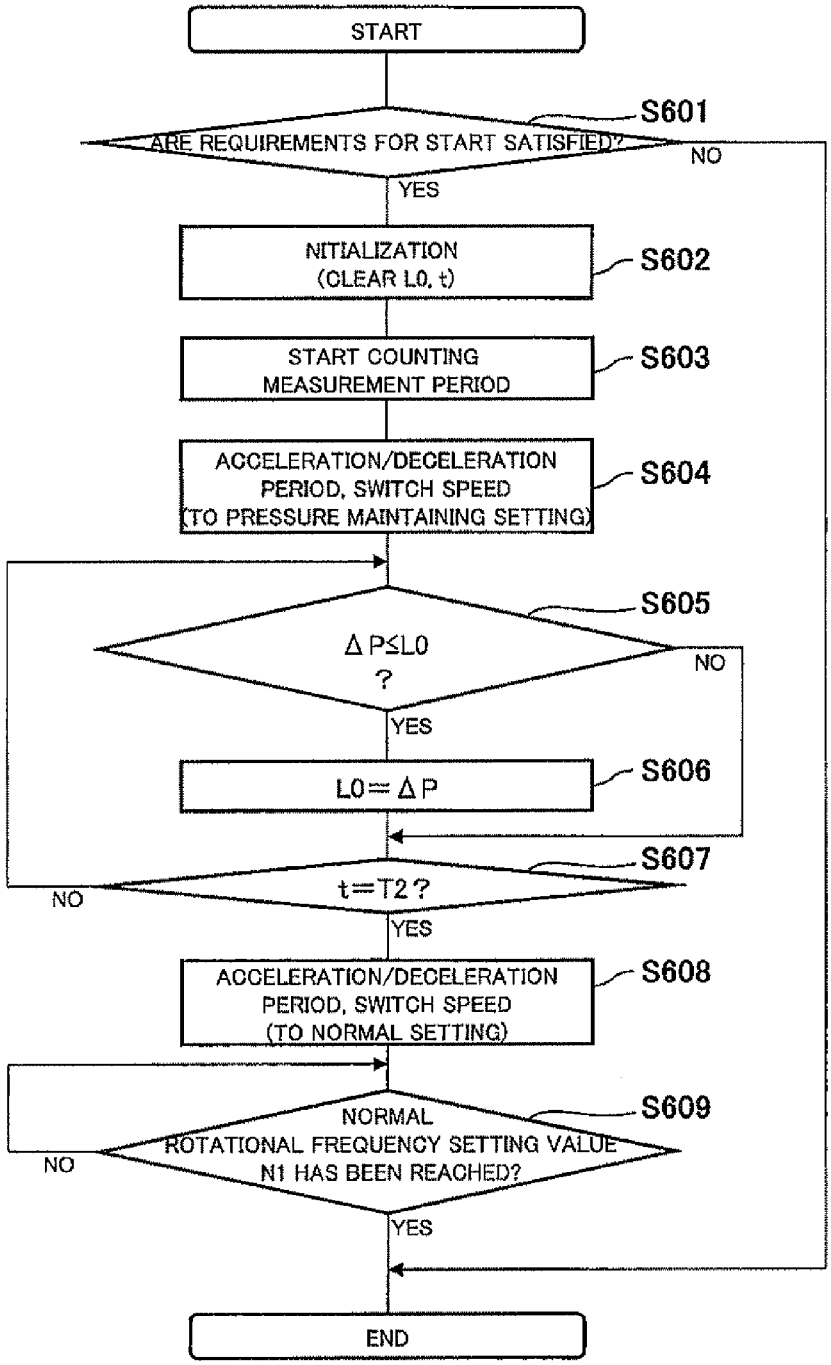
FIG. 6 is a flowchart showing a flow of an auto-tuning process according to Embodiment 2 of the present invention.
Figure 7:
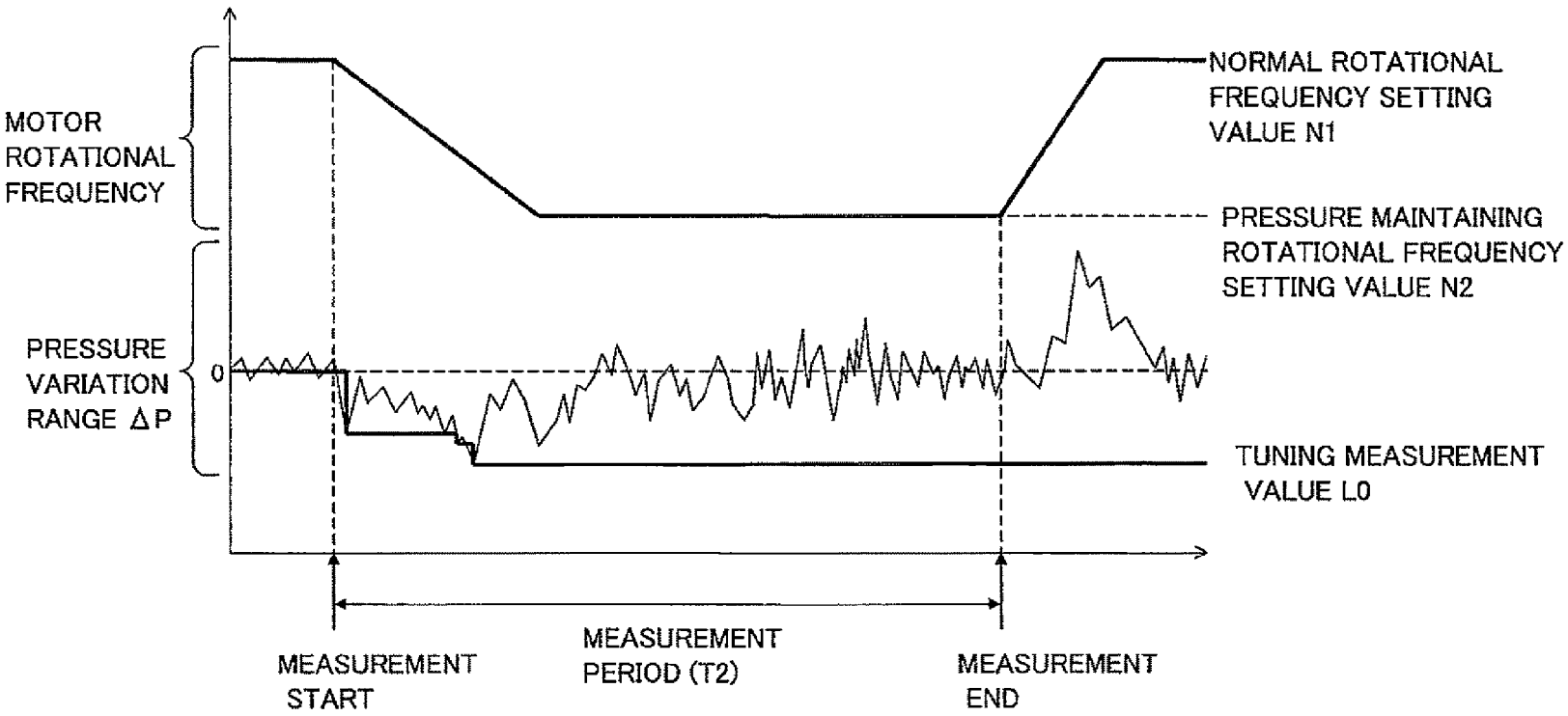
FIG. 7 is a wave form chart for use in describing the auto-tuning process according to Embodiment 2 of the present invention.
Figure 8:
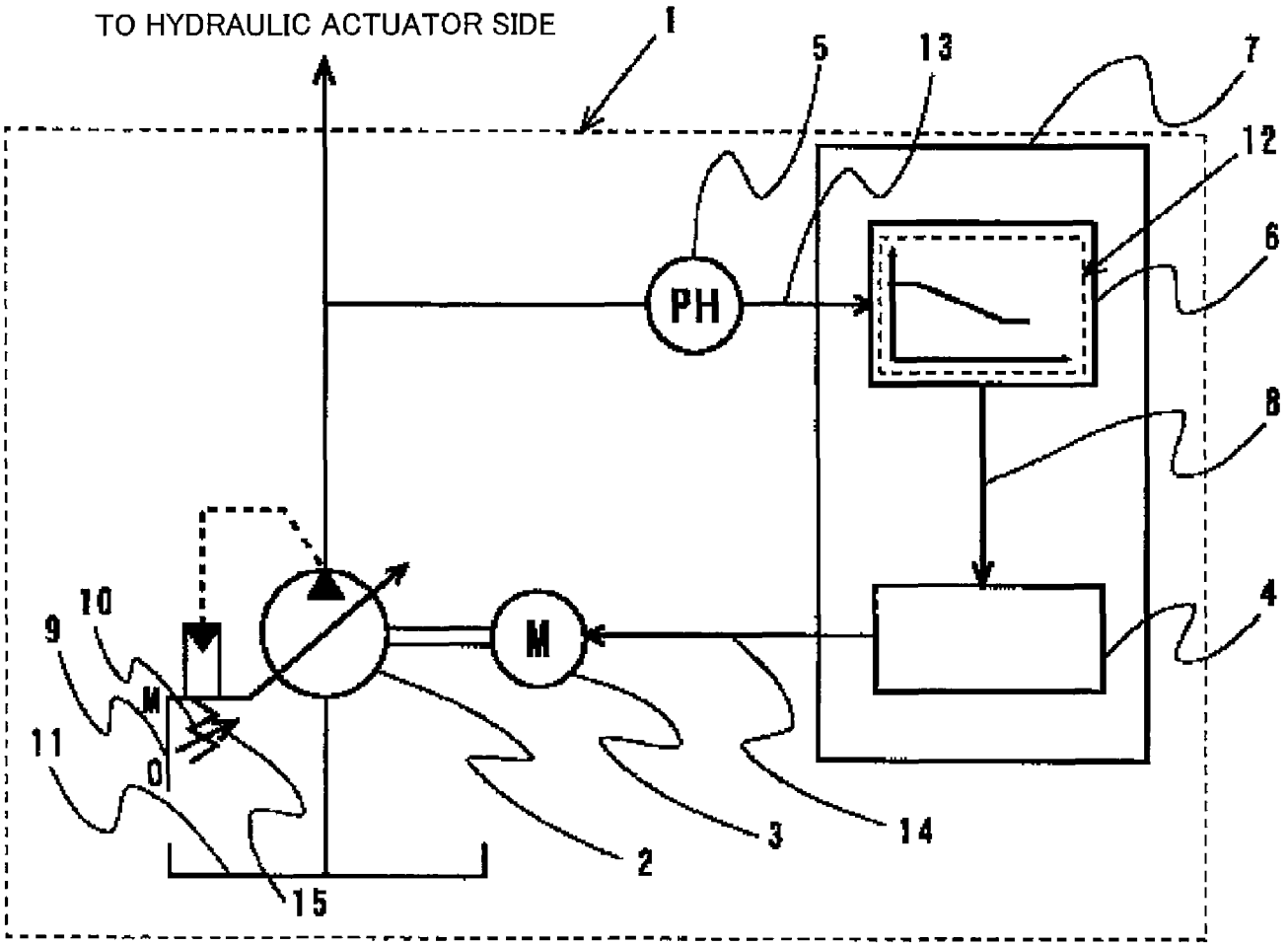
Fig. 8 PRIOR ART
FIG. 8 shows a configuration of a conventional hydraulic system (inverter-driven hydraulic unit).

FIG. 6 is a flowchart showing a flow of an auto-tuning process according to Embodiment 2 of the present invention. It should be noted that the process steps S601 to S609 shown in FIG. 6 are associated with the first threshold calculator which is claimed in the claims of the present application. FIG. 7 is a wave form chart for use in describing the auto-tuning process shown in FIG. 6.

First, if requirements for starting the auto-tuning process are satisfied (step S601: YES), the CPU 205 performs a process of clearing the reference level L0 for the pressure maintained state detection level L1 and a count time t for counting a measurement period (step S602). The requirements for starting the auto-tuning process include, for example, powering on the control panel 100 or pressing a button dedicated for starting the auto-tuning process. The requirements for starting the auto-tuning process also include the variable speed motor 30 being in a state of rotating based on the inverter rotational frequency command S which indicates, as a command, the normal rotational frequency setting value N1.

Next, when measurement of the reference level L0 is started, the CPU 205 starts counting up the count time t for counting a measurement period T2 (step S603). At the same time as starting the counting, the CPU 205 switches the rotational frequency of the variable speed motor 30 from the normal rotational frequency setting value N1 to the pressure maintaining rotational frequency setting value N2 at predetermined acceleration as indicated by the waveform, in FIG. 7, of the motor rotational frequency after the start of the measurement (step S604).

Subsequently, the CPU 205 detects the pressure variation range ΔP based on the pressure detection value P obtained from the AD converter 208, and determines whether the pressure variation range ΔP is less than or equal to the currently set reference level L0 (step S605). If the pressure variation range ΔP is less than or equal to the reference level L0 (step S605: YES), the CPU 205 updates the reference level L0 to the pressure variation range ΔP (step S606). On the other hand, if the pressure variation range ΔP is greater than the reference level L0 (step S605: NO), the CPU 205 does not update the reference level L0. The steps S605 and S606 are repeated until the length of the count time t reaches the measurement period T2 (S607: YES).

That is, in the measurement period T2 from the start to the end of the measurement as shown in FIG. 7, the rotational frequency of the variable speed motor 30 that is stable at the normal rotational frequency setting value N1 is switched, at predetermined acceleration, to the pressure maintaining rotational frequency setting value N2. In this manner, a state where the detection value of the pressure detector 40 varies is simulated. Then, values of the pressure variation range ΔP are sequentially detected during the measurement period T2, and the lower limit value among the detected values of the pressure variation range ΔP (i.e., a detected value that indicates a negative change amount and of which the absolute value is greatest among detected values indicating negative change amounts) is obtained. The lower limit value is set as the reference level L0. It should be noted that as described above, the pressure maintained state detection level L1 is obtained by multiplying the reference level L0 by the correction coefficient k.

Next, as indicated by the waveform, in FIG. 7, of the motor rotational frequency after the end of the measurement, the CPU 205 switches the rotational frequency of the variable speed motor 30 from the pressure maintaining rotational frequency setting value N2 to the normal rotational frequency setting value N1 at predetermined acceleration (step S608). The CPU 205 ends the auto-tuning process when recognizing that the rotational frequency of the variable speed motor 30 has reached the normal rotational frequency setting value N1 during the acceleration/deceleration period (S609: YES).

[Advantageous Effects]

According to conventional hydraulic systems, it is difficult to set the rotational frequency conditions as shown in FIG. 9 if flow characteristics required by the hydraulic actuator 50 and the characteristic curve of the hydraulic pump are unknown. In contrast, according to Embodiment 2 of the present invention, even if the characteristic curve of the hydraulic pump, and the like, are unknown, the pressure maintained state detection level L1 can be automatically set.

From the foregoing description, numerous modifications and other embodiments of the present invention are obvious to one skilled in the art. Therefore, the foregoing description should be interpreted only as an example and is provided for the purpose of teaching the best mode for carrying out the present invention to one skilled in the art. The structures and/or functional details may be substantially modified without departing from the spirit of the present invention.

INDUSTRIAL APPLICABILITY

The present invention is particularly useful for a hydraulic system that aims at saving energy by reducing the rotational frequency of a variable speed motor when a variable displacement pump is in a pressure maintained state.

REFERENCE SIGNS LIST

20 variable displacement pump
30 variable speed motor
40 pressure detector
50 hydraulic actuator
60 commercial power supply
100 control panel
110 variable speed control device (hydraulic pump operating device)
111 diode rectifier
112 smoothing capacitor
113 inverter circuit
200 controller
201 frequency setter
202 acceleration/deceleration calculator
203 voltage command calculator
204 PWM calculator
205 CPU
206 memory
207 operation program
208 AD converter
120 speed control section
121 pressure variation range detection section
122 high-pass filter section
123 low-pass filter section
124 pressure variation range determination section
125 on-delay timer section
128 pressure drop detection section
129 pressure maintained state detection section
126, 127 switch section
130, 140, 150 contactor

The invention claimed is:

1. A hydraulic pump operating device for use in a hydraulic system, the hydraulic system including:

a variable speed motor;

a hydraulic pump driven by the variable speed motor; and a pressure detector configured to detect a discharge pressure of the hydraulic pump, the hydraulic pump operating device comprising:

a pressure variation range detector configured to detect a range of variation of the discharge pressure detected by the pressure detector;

a speed controller configured to control the speed of the variable speed motor based on the detected range of variation of the discharge pressure; and a pressure maintained state detector, the pressure maintained state detector being configured to detect a state where the discharge pressure is maintained, based on the range of variation of the discharge pressure which is detected by the pressure variation range detector;

wherein the speed controller decelerates the variable speed motor in response to the pressure maintained state detector detecting the state where the discharge pressure is maintained.

2. The hydraulic pump operating device for use in the hydraulic system, according to claim 1, wherein the pressure maintained state detector determines whether a state where the range of variation of the discharge pressure, which is detected by the pressure variation range detector, is less than or equal to a first threshold has continued for a predetermined period, and the pressure maintained state detector detects the state where the discharge pressure is maintained when having determined that the state where the range of variation of the discharge pressure is less than or equal to the first threshold has continued for the predetermined period.

3. The hydraulic pump operating device for use in the hydraulic system, according to claim 1, wherein if the pressure maintained state detector detects the state where the discharge pressure is maintained, then the speed controller switches a rotational frequency of the variable speed motor from a first rotational frequency to a second rotational frequency which is lower than the first rotational frequency.

4. The hydraulic pump operating device for use in the hydraulic system, according to claim 3, the hydraulic pump operating device further comprising a pressure drop detector, wherein the pressure drop detector determines whether the discharge pressure detected by the pressure detector is less than or equal to a second threshold, and if the pressure drop detector determines that the discharge pressure is less than or equal to the second threshold, then the speed controller either maintains the rotational frequency of the variable speed motor at the first rotational frequency, or switches the rotational frequency of the variable speed motor from the second rotational frequency to the first rotational frequency.

5. The hydraulic pump operating device for use in the hydraulic system, according to claim 1, wherein the pressure variation range detector detects the range of variation of the discharge pressure detected by the pressure detector by high-pass filtering the discharge pressure.

6. The hydraulic pump operating device for use in the hydraulic system, according to claim 1, the hydraulic pump operating device further comprising a first threshold calculator, wherein the speed controller switches a rotational frequency of the variable speed motor from a first rotational frequency to a second rotational frequency, and then for a predetermined period, the pressure variation range detector detects the range of variation of the discharge pressure, and the first threshold calculator detects a lower limit value of the range of variation detected by the pressure variation range detector and calculates a first threshold based on the detected lower limit value.

7. A method of operating a hydraulic pump in a hydraulic system, the hydraulic system including:

a variable speed motor;

a hydraulic pump driven by the variable speed motor, the hydraulic pump including a pressure maintained state detector; and a pressure detector configured to detect a discharge pressure of the hydraulic pump, the method comprising:

detecting, by a pressure variation range detector, a range of variation of the discharge pressure detected by the pressure detector; and controlling, by a speed controller, the speed of the variable speed motor based on the detected range of variation of the discharge pressure, the pressure maintained state detector being configured to detect a state where the discharge pressure is maintained, based on the range of variation of the discharge pressure which is detected by the pressure variation range detector;

wherein the speed controller decelerates the variable speed motor in response to the pressure maintained state detector detecting the state where the discharge pressure is maintained.

* * * * *